United States Patent [19]

Houchins et al.

[11] 4,369,532

[45] Jan. 25, 1983

[54] SINK ASSEMBLY

[76] Inventors: Stanley L. Houchins, Rte. #2, Box 302; Thomas B. Jackson, Rte. #2, Box 3A, both of Max Meadows, Va. 24360

[21] Appl. No.: 210,718

[22] Filed: Nov. 26, 1980

[51] Int. Cl.[3] ..... A47K 1/04

[52] U.S. Cl. ..... 4/619; 4/630; 4/639; 4/640; 4/658

[58] Field of Search ..... 4/619, 640, 653, 650, 4/662, 661, 639, 252 A, 658, 612-613, 630

[56] References Cited

U.S. PATENT DOCUMENTS

| | | | |
|---|---|---|---|
| 1,785,877 | 12/1930 | Rubner | 4/252 A |
| 2,180,902 | 11/1939 | Herodes et al. | 4/252 A |
| 2,320,187 | 5/1943 | Lawler | 4/252 A |
| 2,479,000 | 8/1949 | Buczkowski | 4/252 A |
| 2,486,824 | 11/1949 | Daniels | 4/167 |
| 2,499,115 | 2/1950 | Shobe | 4/252 A |
| 2,514,001 | 7/1950 | Knuth | 4/658 |
| 2,515,099 | 7/1950 | Smith | 312/236 |
| 2,542,338 | 2/1951 | Laufenberg | 4/252 |
| 2,644,955 | 7/1953 | Matthews | 4/252 A |
| 2,876,457 | 3/1959 | Kaiser | 4/4 |
| 3,713,176 | 1/1973 | Stock | 4/662 |
| 3,742,520 | 7/1973 | Bernardi | 4/662 |
| 3,837,011 | 9/1974 | McTighe et al. | 4/662 |

*Primary Examiner*—Henry K. Artis

*Attorney, Agent, or Firm*—Griffin, Branigan & Butler

[57] ABSTRACT

A sink assembly of a type including an enclosing cabinet (14) for supporting a sink bowl (16) from a floor (24) includes a liquid-impervious cabinet liner (22) supported by the cabinet (14) within an enclosed space (32) below the sink bowl (16) and its drain pipe (20) for catching water dripping from leaks and condensations. The sink liner (22) communicates with a second drain pipe (52) which exhausts water from the sink liner (22). The sink liner (22) is constructed so that its drain pan (42) is raised above a cabinet floor (40), with the drain pan (42) having tapered surfaces for accelerating flow toward the second drain pipe (52).

13 Claims, 3 Drawing Figures

SINK ASSEMBLY

BACKGROUND OF THE INVENTION

This invention relates broadly to the art of sinks, and more particularly to sink cabinets, and to apparatus for protecting sink cabinets and houses from water damage.

It has been normal practice since around 1940 to 1950 to construct sink assemblies having enclosed cabinets positioned below sink bowls, for supporting the sink bowls. Such sink assemblies have been found to be more aesthically pleasing than "bare" sink bowls and have also had the practical advantage of "using" what is otherwise wasted space below the sink bowls. However, such structures magnify problems which theretofore were not significant.

A significant problem involved with such sink assemblies is that water often gets into the enclosures below the sink bowls and causes damage. There are various sources of water, for example: (1) it leaks through cabinet tops around the sink bowls, and other openings in the cabinets; (2) the drain pipes of the sink bowls spring leaks; and, (3) condensation takes place on bottoms of the sink bowls and on sink drain pipes in the cabinet enclosure. This water problem is enhanced by a lack of visibility for sink users of the enclosed spaces under the sink bowls. Thus, water damage often occurs without users realizing that water is accumulating below the sink bowls. Such water damage includes mildew, rotting, and damaged articles stored in the cabinets below the sinks. In addition to damaging the cabinets and houses, this water damage sometimes makes it difficult to keep the cabinets clean and neat.

Thus, it is an object of this invention to provide a sink assembly whose cabinet enclosure and whose house in which the sink assembly is mounted are protected from water damage.

It is also an object of this invention to provide a sink assembly whose enclosed cabinet can be kept neat and clean even though water may get into the enclosure space on occasion.

Further it is an object of this invention to provide a sink assembly which is not unduly expensive to manufacture.

Finally, it is an object of this invention to provide a method of protecting sink assembly cabinet enclosures, and houses generally, from water which is sometimes discharged at sinks.

SUMMARY

According to principles of this invention, a sink cabinet liner is located in a cabinet enclosure below a sink bowl to catch water falling therein from leaks through the cabinet, leaks in the bowl drain pipe, condensation, etc. The liner forms a bottom surface of the cabinet on which goods can be stored. The liner has a drain therein for draining water accumulated by the liner outside of the house.

BRIEF DESCRIPTION OF THE DRAWINGS

The foregoing and other objects, features and advantages of the invention will be apparent from the following more particular description of the preferred embodiments of the invention, as illustrated in the accompanying drawings in which like reference characters refer to the same parts throughout different views. The drawings are not necessarily to scale, emphasis instead being placed upon illustrating principles of the invention.

DESCRIPTION OF PREFERRED EMBODIMENTS

Figure 1:
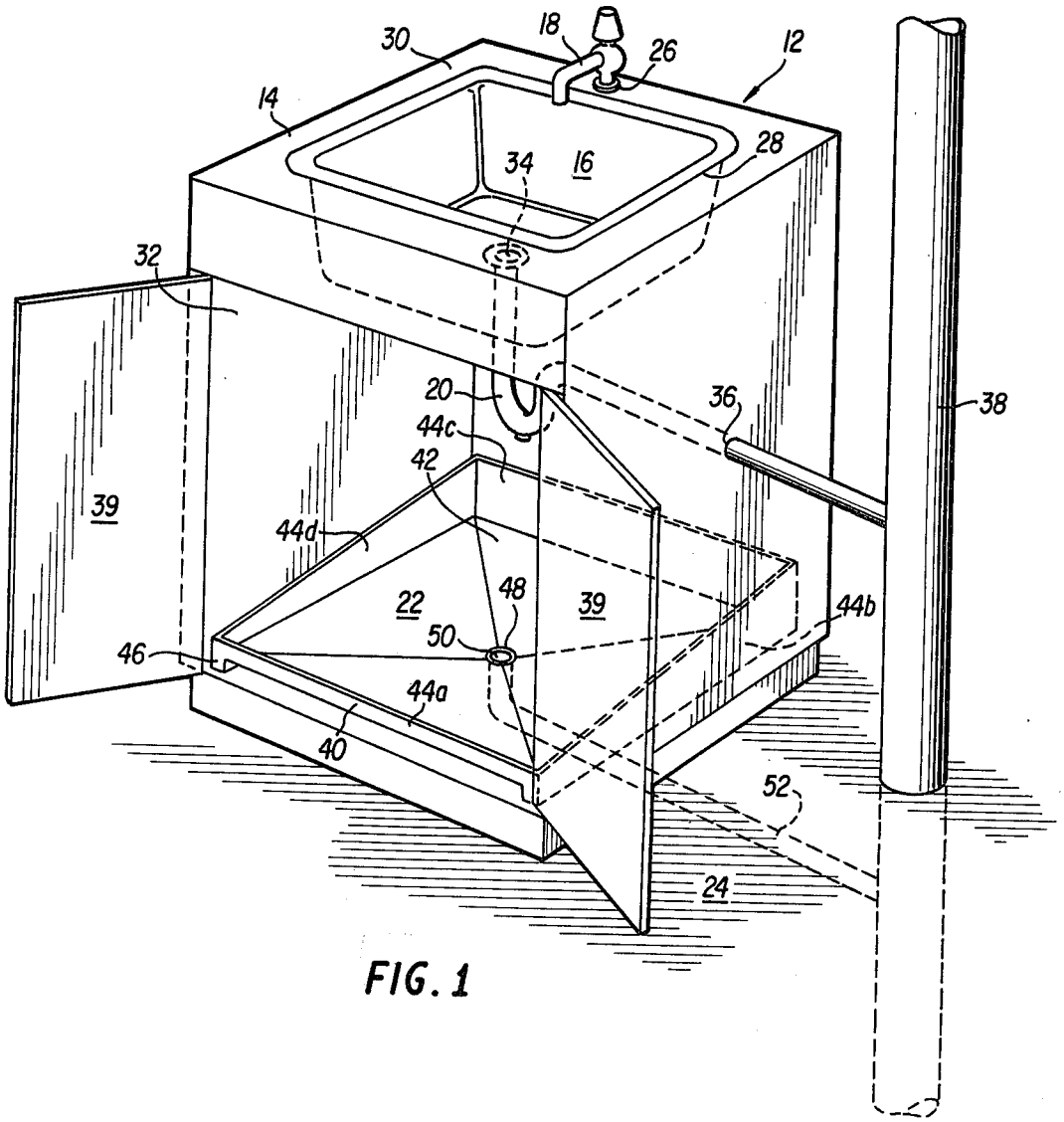
FIG. 1 is an isometric view of a sink assembly of this invention having a cabinet-enclosure liner.

FIG. 1 depicts a sink assembly 12 including a cabinet 14, a sink bowl 16, a water faucet 18, a sink-bowl drain 20, and a cabinet liner 22.

The cabinet 14 is supported by a house floor 24 and, in turn, supports the sink bowl 16 and the water faucet 18 in holes 26 and 28 respectively which extend through an upper surface 30 of the cabinet 14. The sink bowl 16 extends through the hole 28 in the upper surface 30 down into an enclosed space 32 of the cabinet 14 where it communicates with the sink-bowl drain 20. In this respect, there is a drain hole 34 in the sink bowl 16 through which water drains into the sink-bowl drain 20. The sink-drain 20 thereafter extends through an opening 36 in the back of the cabinet 14 and finally into a house drain stack 38 for being exhausted outside of a house in which the sink assembly 12 is located. Doors 39 allow access into the space 32 from the front of the cabinet 14.

The cabinet 14 includes a floor 40 on which the cabinet liner 22 sits. The cabinet liner 22 is, in a preferred embodiment, constructed of a pliable PVC molded plastic. Such a plastic is substantially chemical- and heat-resistant and flame retardant, and, because of its flexibility, can be retrofitted more easily into existing sink-assembly cabinets. The cabinet liner 22 has a drain pan 42 from which vertical front, back, and side walls 44 *a, b, c* and *d* extend. The front wall 44*a* has a height of about 1½ inches so that easy access can be had to items (such as boxes of soap, brushes, etc.) which are stored on the drain pan 42. However, the back wall 44*c* is relatively high, so that it can catch water which sprays rearwardly thereagainst. In this respect, it is best to make the back and side walls 44*c*, 44*b* and 44*d* as high as possible to catch laterally squirting water. In the depicted embodiment the side walls 44*b* and *d* taper downwardly from the back wall 44*c* so as to match the height of the front wall 44*a* at the transition therebetween. The back wall 44*c* is approximately 15 inches high, however, it can be higher and it is not necessary that the side walls 44*b* and *d* be tapered.

The liner 22 is sized such that its back and side walls 44*c*, *b* and *d* are immediately adjacent to side and back walls of the cabinet 14 so as to cut down very little on the storage capacity of the cabinet 14.

The outside periphery of the drain pan 42 is raised above the cabinet floor 40 by means of legs 46. The drain pan 42 tapers downwardly toward a drain-hose nipple 48 which defines a drain hole 50. The drain hole 50 communicates with a second drain pipe 52 which, in turn, leads into the house drain stack 38. The second drain pipe 52 can be metal, or it can be plastic. This hose can also be of a flexible nature so that it can more easily be retrofitted to existing sink cabinets. The fact that the drain pan 42 is raised above the cabinet floor 40 by the legs 46 is beneficial in that free air circulation is allowed between the bottom of the drain pan 42 and the cabinet floor 40 so as to avoid moisture build-up therebetween. Further, by raising the periphery of the drain pan 42, liquid flow toward the drain hole 50 is thereby enhanced.

In a preferred embodiment, the cabinet liner 22 is sold with higher sides 44 than are shown in FIG. 1 and a user simply cuts them to an appropriate size for fitting into a sink cabinet. In this manner, one can have the highest liner size permissible for a particular sink liner to thereby aid in catching laterally sprayed water.

Figure 2:
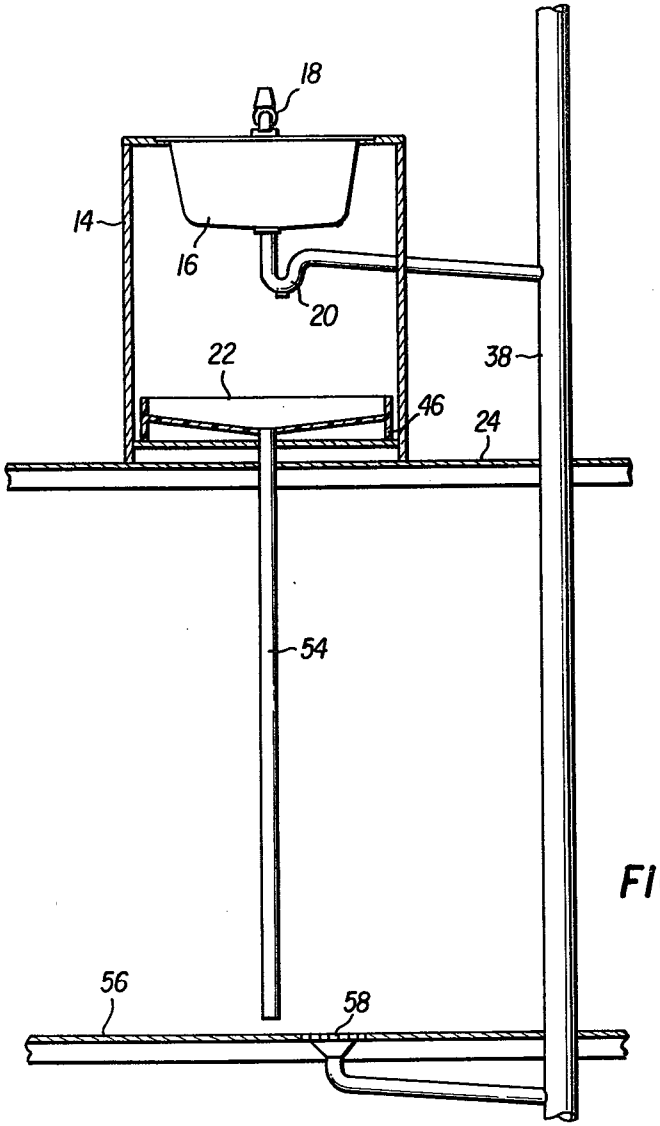
FIG. 2 is a front cut-away view of a sink assembly of this invention having a different type of liner drain system than the liner drain system of the FIG. 1 embodiment; and, FIG. 3 is a side cut-away view of a sink assembly of this invention having yet a third type of drain system.

The sink assembly of FIG. 2 is substantially the same as the sink assembly of FIG. 1 with the exception that, in the FIG. 2 embodiment, a second drain pipe 54, rather than leading directly into a drain stack 38, is arranged to extend downwardly to a basement floor drain 58. Thus, any water drained from a cabinet liner 22 of the FIG. 2 arrangement drains into the floor drain 58 of a basement floor 56. In this respect, it should be realized that the flow of water from the cabinet liner 22 will not normally be great. This liner is intended to take emergency water which leaks, or condenses from the sink bowl 16 and the sink-bowl drain 20.

Figure 3:
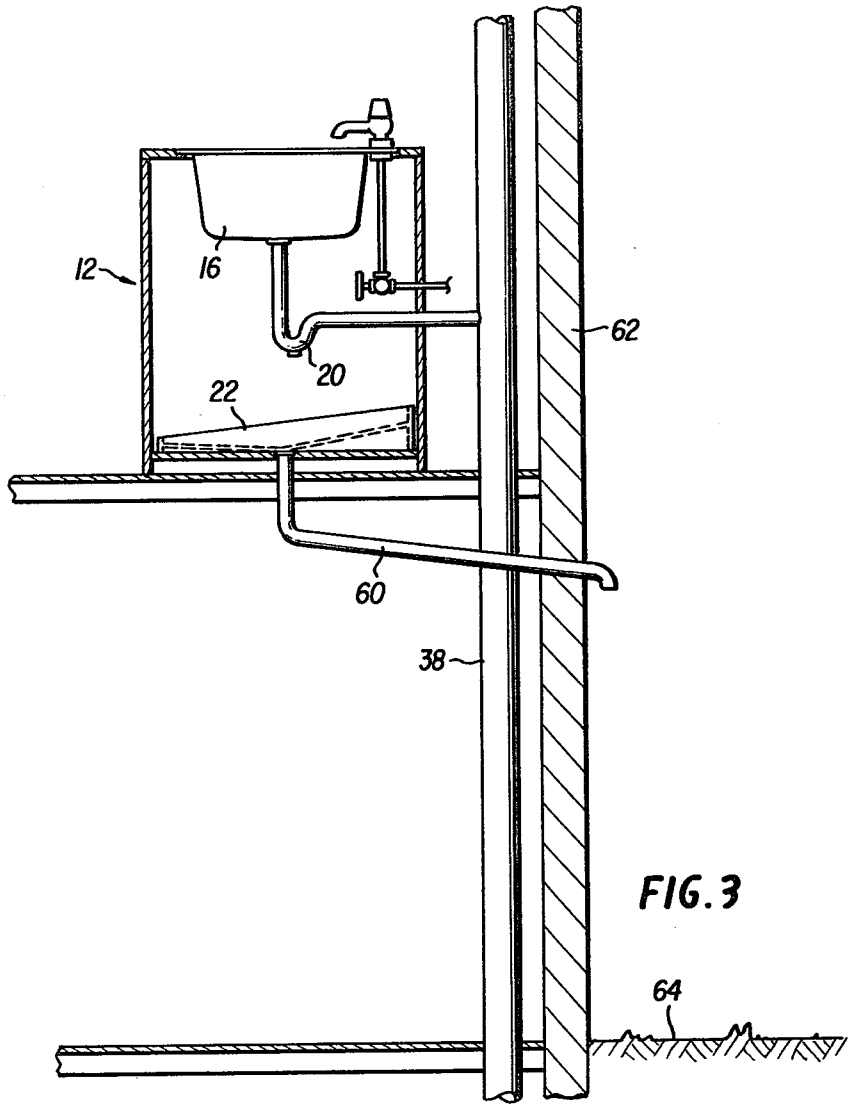

In FIG. 3, a second drain pipe 60 of the cabinet liner 22 does not connect with the house drain stack 38 at all, but rather extends through an exterior wall 62 of a house in which the sink assembly 12 is located to deposit water on the ground 64 outside of the house. Again, the flow of water from the liner 22 will not normally be great, and such an arrangement can be tolerated.

It will be appreciated by those skilled in the art that the sink assembly described herein, having a drained cabinet liner, overcomes various shortcomings of prior-art enclosed sink-supporting-cabinet assemblies. The liner prevents potential water damage and allows the cabinet interior to be kept cleaner and neater than was normally the case. The sink assembly described herein is relatively uncomplicated in structure, and inexpensive to install.

While the invention has been particularly shown and described with reference to a preferred embodiment, it will be understood by those skilled in the art that various changes in form and detail may be made therein without departing from the spirit and scope of the invention. In one embodiment, for example, the cabinet liner 22 does not include a drain. In this embodiment the liner must be wiped out with a cloth when it catches water. This embodiment of the liner has the advantage of being more portable than the liner with a drain. Such a liner can be easily added to an already existing kitchen cabinet without reducing the storage space of the cabinet, since the liner substantially fits the interior of the cabinet.

The embodiments of the invention in which an exclusive property or privilege are claimed are defined as follows:

1. A sink assembly for use in a house comprising:

a cabinet for supporting a sink from a floor, said cabinet having an upper surface with a sink opening therein and including enclosing cabinet walls and a lower-most floor below said opening for defining an enclosed space below said sink opening, said cabinet walls including a cabinet door on a front side thereof for allowing access into said enclosed space below said sink opening;

a sink bowl supported by the upper surface of said cabinet, said sink bowl extending into said sink opening, said sink bowl having a drain opening located in said enclosed space;

a water-supply means located above said upper surface for supplying water into said sink bowl;

a first drain pipe connected to said sink bowl at said drain opening for exhausting water from said sink outside of said house;

a separate liquid-impervious cabinet liner supported by the lower-most floor of said cabinet within said enclosed space below said sink bowl for catching water dripping from said sink bowl and said first drain pipe, said separate liquid-impervious cabinet liner having a liner floor means adjacent said cabinet floor for forming a drain pan supported to be above the lowermost floor of the cabinet for receiving goods to be stored thereon.

2. A sink assembly as in claim 1 wherein said cabinet liner has a hole in the liner floor means thereof; and, a second drain pipe connected to said cabinet liner at said hole for exhausting water from said sink liner outside of said house.

3. A sink assembly as in claim 2 wherein said first and second drain pipes are connected to a house drain stack.

4. A sink assembly as in claim 2 wherein said first drain pipe is connected to a house drain stack but said second drain pipe exhausts onto the ground outside of said house.

5. A sink assembly as in claim 1 or 2 wherein said cabinet liner is supported by a lowermost floor of said cabinet inside said enclosed space so that the liner floor means is immediately adjacent to said cabinet floor.

6. A sink assembly as in claim 4 wherein the drain pan is supported to be immediately above the lowermost floor of the cabinet.

7. A sink assembly as in claim 6 wherein said liner drain pan is tapered downwardly toward said liner hole.

8. A sink assembly as in claim 5 wherein said cabinet liner includes front, back, and side walls immediately adjacent said enclosing cabinet walls which extend vertically above said liner drain pan, said front wall being short in comparison with said back and side walls.

9. A sink assembly as in claim 7 wherein said side walls taper in height from the back wall to the front wall.

10. A sink assembly as in claim 1 wherein said side walls taper in height from the back wall to the front wall.

11. A sink assembly as in claim 2 wherein said liner includes a drain pan which is tapered downwardly toward said liner hole.

12. A sink assembly as in claim 1 wherein said cabinet liner is constructed of a semi-flexible plastic.

13. A method of protecting a sink supporting cabinet comprising the steps of positioning a pan-shaped liner within the cabinet below said sink and supporting said liner on a floor of said cabinet immediately adjacent to, but above, said cabinet floor so that goods can be stored on said liner, said liner having a hole in the bottom thereof;

coupling a drain pipe to said liner at said hole for transmitting said water from said liner outside of a house in which said sink supporting cabinet is located.

* * * * *